US011585573B2

(12) United States Patent
Zhao et al.

(10) Patent No.: US 11,585,573 B2
(45) Date of Patent: Feb. 21, 2023

(54) GAS MIXING DEVICE AND GAS WATER HEATING DEVICE

(71) Applicant: A.O. SMITH (CHINA) WATER HEATER CO., LTD., Jiangsu (CN)

(72) Inventors: Le Zhao, Jiangsu (CN); Ziwen Fu, Jiangsu (CN); Xin Cao, Jiangsu (CN)

(73) Assignee: A. O. Smith Corporation, Milwaukee, WI (US)

( * ) Notice: Subject to any disclaimer, the term of this patent is extended or adjusted under 35 U.S.C. 154(b) by 57 days.

(21) Appl. No.: 17/136,541

(22) Filed: Dec. 29, 2020

(65) Prior Publication Data

US 2021/0404706 A1 Dec. 30, 2021

(30) Foreign Application Priority Data

Jun. 24, 2020 (CN) ..... 202021208020.5

(51) Int. Cl.

| | |
|---|---|
| ***F24H 9/00*** | (2022.01) |
| ***F23K 5/00*** | (2006.01) |
| ***F23N 1/02*** | (2006.01) |
| ***F24H 1/00*** | (2022.01) |

(52) U.S. Cl.

CPC ..... *F24H 9/0026* (2013.01); *F23K 5/007* (2013.01); *F23N 1/027* (2013.01); *F23K 2900/05002* (2013.01); *F23N 2235/24* (2020.01); *F23N 2241/04* (2020.01); *F24H 1/0027* (2013.01)

(58) Field of Classification Search

None

See application file for complete search history.

(56) References Cited

U.S. PATENT DOCUMENTS

| | | | | |
|---|---|---|---|---|
| 4,420,439 | A * | 12/1983 | Hartel | F02M 19/0228 123/549 |
| 2004/0237947 | A1* | 12/2004 | Strohle | F23N 1/027 123/527 |
| 2016/0069563 | A1* | 3/2016 | Cazard | F23N 5/188 431/354 |
| 2018/0231243 | A1* | 8/2018 | Nonoyama | F23N 1/025 |

FOREIGN PATENT DOCUMENTS

| | | | | |
|---|---|---|---|---|
| EP | 0614045 | A1 * | 9/1994 | F23D 14/60 |
| WO | WO-2013060997 | A2 * | 5/2013 | F23D 14/60 |

* cited by examiner

*Primary Examiner* — Steven S Anderson, II
*Assistant Examiner* — Kurt J Wolford
(74) *Attorney, Agent, or Firm* — Michael Best & Friedrich LLP

(57) ABSTRACT

The present disclosure discloses a gas mixing device and a gas water heating device. In which, a gas mixing device, comprises: a shell provided with a fuel gas channel for inputting fuel gas, an air channel for inputting air and a gas mixing channel, the fuel gas channel being provided with a first cut-off portion capable of changing a flow area, and the air channel being provided with a second cut-off portion capable of changing a flow area; a moving part movable in the shell, the moving part simultaneously changing the flow areas of the first cut-off portion and the second cut-off portions by moving. The gas mixing device and the gas water heating device can provide a higher regulation ratio, thereby solving the problem that the water temperature is too high in summer.

17 Claims, 6 Drawing Sheets

GAS MIXING DEVICE AND GAS WATER HEATING DEVICE

CROSS REFERENCE TO RELATED APPLICATION

This application claims the priority to the Chinese Patent Application No. 202021208020.5, filed on Jun. 24, 2020, which is hereby incorporated by reference in its entirety.

TECHNICAL FIELD

The present disclosure relates to the field of gas mixing, in particular to a gas mixing device.

The present disclosure also relates to the field of water heating devices, in particular to a gas water heating device.

BACKGROUND

Fully premixed gas combustion refers to a combustion method in which gas is mixed with adequate air before entering the combustor, and no air is needed during the combustion. The flame propagation speed of fully premixed combustion is high, and the volumetric heat intensity of the combustion chamber is very high, generally up to $28\sim56*10^3 Kw/m^2$ or higher. Complete combustion can be achieved at a small excess air coefficient, and there is almost no chemical incomplete combustion phenomenon.

In a fully premixed gas water heater, a Venturi premixing device is generally used to ensure full mixing of fuel gas and air, making the air flow velocity field uniform, thereby ensuring that the air flow velocity at each point of the combustor is greater than the flame propagation velocity under the lowest load. At the same time, the uniformity of the flame on the surface of the combustor is ensured, thus the flame on the surface of the combustor is prevented from being too long and contacting the surface of the heat exchanger to cause incomplete combustion.

However, in general, the Venturi tube of the current fully premixed gas water has a relatively small regulation ratio of no more than 1:10, thus the problem that the water temperature is too high under a low load still exists, which, especially in summer, will reduce the user experience. Moreover, there is also a problem of unstable flue gas emission during power regulation.

SUMMARY

In view of the above deficiencies, one purpose of the present disclosure is to provide a gas mixing device and a gas water heating device that can provide a higher regulation ratio, thereby solving the problem that the water temperature is too high in summer.

Another purpose of the present disclosure is to provide a gas mixing device and a gas water heating device that can improve the stability of flue gas emission during power regulation.

To achieve the above purposes, the present disclosure adopts the following technical solutions:

A gas mixing device, comprising:

a shell provided with a fuel gas channel for inputting fuel gas, an air channel for inputting air and a gas mixing channel, the fuel gas channel being provided with a first cut-off portion capable of changing a flow area, and the air channel being provided with a second cut-off portion capable of changing a flow area;

a moving part movable in the shell, the moving part simultaneously changing the flow areas of the first cut-off portion and the second cut-off portions by moving.

As a preferred embodiment, a movable contraction structure is provided in the shell; the air channel is located inside the contraction structure; the fuel gas channel is located outside the contraction structure; an internal flow area of the contraction structure gradually decreases in an air flow direction to form a contraction section; at least part of the internal flow area of the gas mixing channel gradually increases in an internal gas flow direction to form a diffusion section; and the fuel gas channel is communicated between the contraction section and the diffusion section.

As a preferred embodiment, a ratio of a maximum flow area to a minimum flow area of the first cut-off portion is 10 to 30; and a ratio of a maximum flow area to a minimum flow area of the second cut-off portion is 2 to 6.

As a preferred embodiment, the moving part moves linearly in the shell.

As a preferred embodiment, the moving part comprises an air cut-off plug and a throat that is disposed to sleeve the air cut-off plug; the contraction structure is provided on the throat; an outer wall of the throat and an inner wall of the shell are provided with sealing structures slidable relative to each other; the sealing structures seal and separate the air channel and the fuel gas channel; the air channel is located inside the throat; and the fuel gas channel is located outside the throat.

As a preferred embodiment, the shell is provided with a driving motor, which simultaneously drives the throat to move and drives the air cut-off plug to move relative to the throat, thereby simultaneously changing the flow areas of the first cut-off portion and the second cut-off portion.

As a preferred embodiment, the shell is provided with a gas mixing tube forming the gas mixing channel; the first cut-off portion is formed between the throat and an end portion of the mixing tube; and the second cut-off portion is formed between the throat and the air cut-off plug.

As a preferred embodiment, the air cut-off plug and the throat move synchronously in a predetermined transmission ratio.

As a preferred embodiment, the throat is connected to the air cut-off plug or a motor shaft of the driving motor through a transmission mechanism; the driving motor directly drives the air cut-off plug to move, and the air cut-off plug or the motor shaft of the driving motor causes the throat to move through the transmission mechanism.

As a preferred embodiment, the transmission mechanism is a linkage mechanism.

As a preferred embodiment, the transmission mechanism comprises a first linkage and a second linkage which are rotatably connected through a pivot shaft; wherein one end of the first linkage is rotatably connected to the air cut-off plug or the motor shaft of the driving motor, and one end of the second linkage is rotatably connected to the throat.

As a preferred embodiment, the driving motor is a linear motor; and the air cut-off plug is fixedly disposed to sleeve an output shaft of the linear motor.

As a preferred embodiment, the shell is provided therein with a guide mechanism defining a moving path of the pivot shaft; and when moving in the moving path, the pivot shaft causes the throat to move linearly.

As a preferred embodiment, the outer wall of the throat is provided with a first mating surface which participates in forming the first cut-off portion; the first mating surface has cambered surfaces with different radians in a moving direction of the throat; and the throat moves so that the cambered surfaces with different radians are respectively matched with the gas mixing tube to change the flow area of the first cut-off portion.

As a preferred embodiment, an upper end of the air cut-off plug is provided with a second mating surface which participates in forming the second cut-off portion; the second mating surface has surfaces with different radians in a moving direction of the air cut-off plug; and the air cut-off plug moves so that surfaces with different radians are respectively matched with an inner wall of the throat to change the flow area of the second cut-off portion.

As a preferred embodiment, the driving motor directly drives the throat and the air cut-off plug to move linearly.

As a preferred embodiment, an output end of the driving motor is provided with a first driving gear and a second driving gear which are coaxially disposed; the air cut-off plug is driven by the driving motor through a first rack and the first driving gear to mesh; the throat is driven by the driving motor through a second rack and the second driving gear to mesh; and an addendum circle diameter of the first driving gear is smaller than that of the second driving gear.

As a preferred embodiment, the shell is provided with a gas mixing tube forming the gas mixing channel; the moving part comprises an air cut-off plug and a throat that is disposed to sleeve the air cut-off plug;

the fuel gas channel is provided therein with a baffle plate; the baffle plate is provided with a flow hole which penetrates the baffle plate; the throat is fixedly provided with a shielding structure for shielding the flow hole; and the shielding structure moves to change a shielded area of the flow hole, so as to change the flow area of the first cut-off portion;

the air cut-off plug is fixedly provided with an air cut-off plate; the shell is provided with a variable-diameter portion; and the air cut-off plate and the variable-diameter portion move relative to each other to change the flow area of the second cut-off portion.

A gas water heating device, comprising the gas mixing device according to any one of the above embodiments.

Advantageous Effect

The gas mixing device provided in one embodiment of the present disclosure simultaneously changes the flow areas of the first cut-off portion and the second cut-off portion by movement of the moving part, and simultaneously changes the input amount of fuel gas and of air while maintaining a mixing ratio between fuel gas and air to thereby change the amount of the mixed gas in the gas mixing channel. Therefore, the regulation ratio of the gas mixing device can be stably changed, and a stable flue gas emission can be achieved.

Particular embodiments of the present disclosure are disclosed in detail with reference to the descriptions and figures in the following, and the ways in which the principle of the present disclosure can be employed are pointed out. It should be appreciated that the embodiments of the present disclosure are not limited in scope thereby.

Features which are described and/or indicated for one embodiment can be used in one or more other embodiments in an identical or similar way, can be combined with features in the other embodiments, or can replace the features in the other embodiments.

It should be emphasized that the term "comprise/include", when used in this text, refers to the presence of features, integers, steps or components, but does not exclude the presence or addition of one or more other features, integers, steps or components.

BRIEF DESCRIPTION OF THE DRAWINGS

In order to explain more clearly the technical solutions in the embodiments in the present disclosure or in the prior art, the following will briefly introduce the figures needed in the description of the embodiments or the prior art. Obviously, figures in the following description are only some embodiments of the present disclosure, and for a person skilled in the art, other figures may also be obtained based on these figures without paying any creative effort.

DETAILED DESCRIPTION

In order to enable persons skilled in the art to better understand the technical solutions in the present disclosure, a clear and comprehensive description to the technical solutions in the embodiments of the present disclosure will be given in the following in combination with the figures in the embodiments of the present disclosure, and obviously, the embodiments described are only part of the embodiments of the present disclosure, rather than all the embodiments of the present disclosure. Based on the embodiments of the present disclosure, all other embodiments obtained by ordinary skilled persons in this field without paying any creative effort should pertain to the scope of protection of the present disclosure.

What needs to be explained is that, when an element is referred to as being "provided on" another element, it can be directly on the other element, or an intervening element may also be present. When an element is considered to be "connected to" another element, it can be directly connected to the other element, or an intervening element may also be present. The terms "perpendicular", "horizontal", "left" and "right" as well as similar expressions used in this text are only for the purpose of explanation, and do not represent a unique embodiment.

Unless otherwise defined, all technical and scientific terms used in this text have the same meaning as commonly understood by persons pertaining to the technical field of the present disclosure. The terminology used in the description of the present invention is for the purpose of describing the specific embodiments only, and is not intended to limit the present disclosure. The term "and/or" used in the text includes any and all combinations of one or more of the associated listed items.

Figure 1:
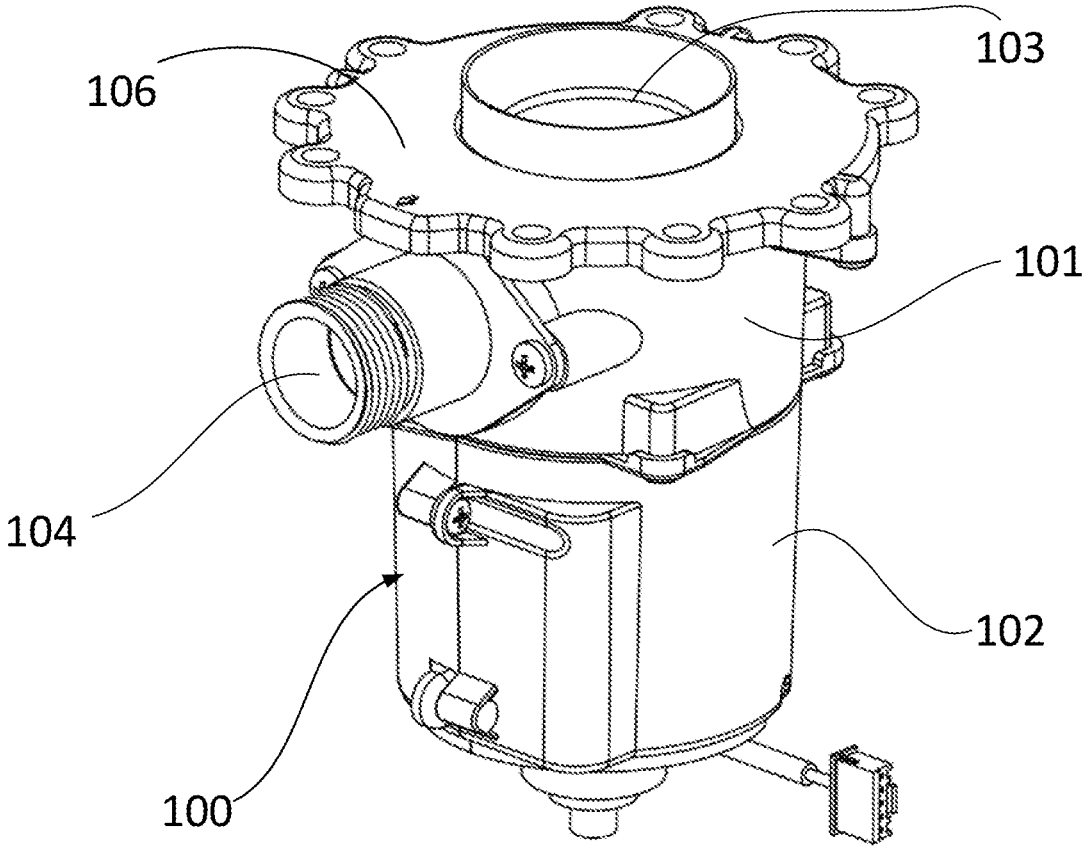
FIG. 1 is a structural diagram of a gas mixing device provided by an embodiment of the present disclosure.
Figure 2:
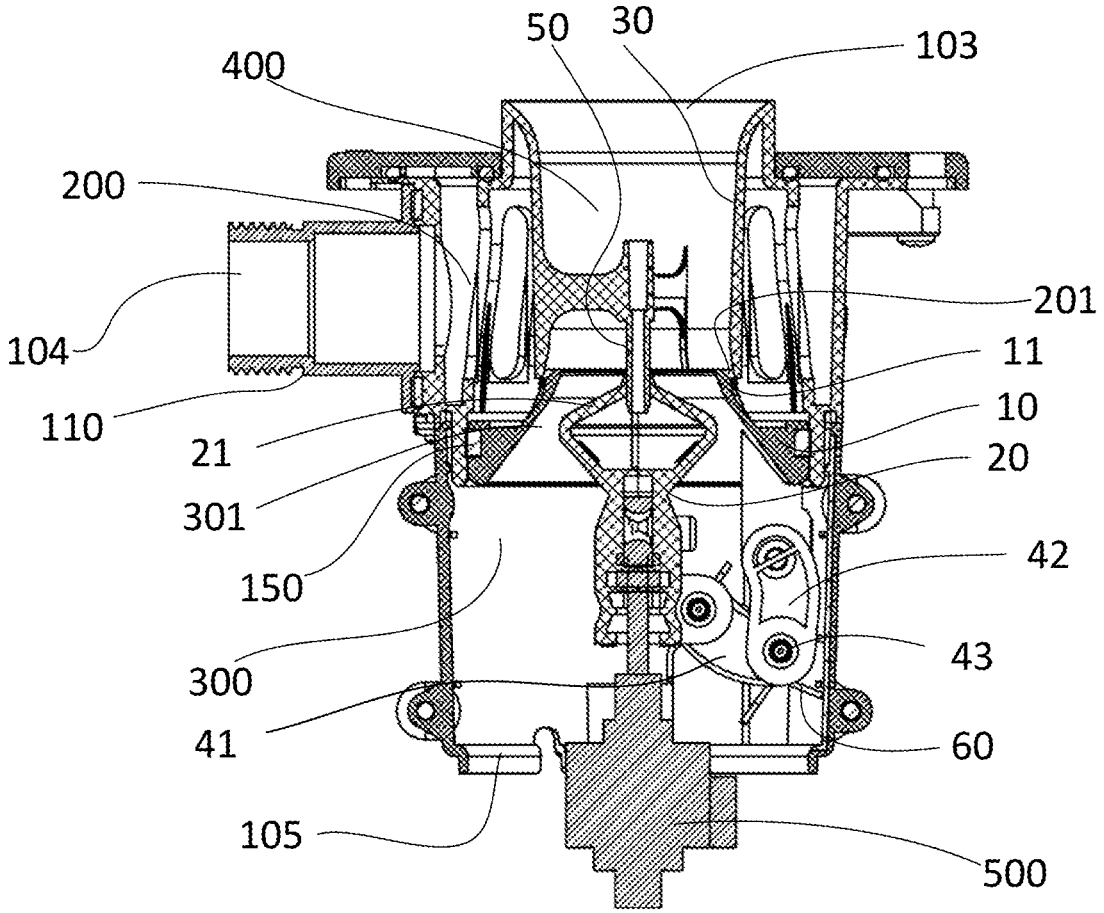
FIG. 2 is a cutaway view of FIG. 1.

Referring to FIGS. 1 and 2, an embodiment of the present disclosure provides a gas mixing device, comprising: a shell 100, and a moving part movable in the shell 100, wherein, the shell 100 is provided with a fuel gas channel 200 for inputting fuel gas, an air channel 300 for inputting air and a gas mixing channel 400. The fuel gas channel 200 is provided with a first cut-off portion 201 capable of changing a flow area, and the air channel 300 is provided with a second cut-off portion 301 capable of changing a flow area.

The moving part simultaneously changes the flow areas of the first cut-off portion 201 and the second cut-off portion 301 by moving.

The gas mixing device provided by the present disclosure simultaneously changes the flow areas of the first cut-off portion 201 and the second cut-off portion 301 by movement of the moving part, and simultaneously changes the input amount of fuel gas and of air while maintaining a mixing ratio between fuel gas and air to thereby change the amount of the mixed gas in the gas mixing channel 400. Therefore, the regulation ratio of the gas mixing device can be stably changed, and a stable flue gas emission can be achieved.

The gas mixing device of this embodiment coordinately changes the fan speed during the change of the regulation ratio, so that the flue gas is stable. High regulation ratio solves the problem that the water temperature is too high in summer. A higher regulation ratio can be realized, lower power can be achieved, a more stable low-load combustion can be maintained.

The gas mixing device of this embodiment is a Venturi tube of a special structure. The air channel 300, the fuel gas channel 200 and the gas mixing channel 400 form the Venturi structure. Air flows through the air channel 300 towards the gas mixing channel 400, generating a negative pressure which forms suction of the fuel gas in the fuel gas channel 200.

To be specific, a movable contraction structure is provided in the shell 100. The contraction structure is a conical structure as a whole. The air channel 300 is located inside the contraction structure. The fuel gas channel 200 is located outside the contraction structure. An internal flow area of the contraction structure gradually decreases in an air flow direction to form a contraction section. At least part of the internal flow area of the gas mixing channel 400 gradually increases in an internal gas flow direction to form a diffusion section, and a mixed gas outlet 103 is formed at the tail end of it. The fuel gas channel 200 is communicated between the contraction section and the diffusion section. Between the contraction section and the diffusion section may be a throat having a flow area that is substantially unchanged in the flow direction. The fuel gas channel 200 is in communication with the throat.

In this embodiment, the moving part may be a single element, and may also be assembled from a plurality of elements. The moving part may comprise a plurality of elements driven directly or indirectly by a driving motor 500. The motion forms of the elements may be the same or different, and the present disclosure does not give limitations to this. The movement form of the moving part in the shell 100 may be rotation, translation and swing, and may even be a combination of a plurality of motions. In this embodiment, the moving part moves linearly in the shell 100. The driving motor 500 has a motor shaft, the moving part can be mounted on the motor shaft, and the moving part can move in an axial direction.

To be specific, the moving part comprises an air cut-off plug 20 and a throat 10 that is disposed to sleeve the air cut-off plug 20. The contraction structure is provided on the throat 10. The contraction structure is a part of the throat 10. The throat 10 can move to change the flow area of the first cut-off portion. The outer wall of the throat 10 and the inner wall of the shell 100 are provided with sealing structures slidable relative to each other. The sealing structures seal and separate the air channel 300 and the fuel gas channel 200. The air channel 300 is located inside the throat 10. The fuel gas channel 200 is located outside the throat 10. The sealing structure may comprise a sealing ring 150 provided on the outer wall of the lower end of the throat 10. The sealing ring 150 and the inner wall of the lower end of the upper shell 101 are fitted and sealed with each other. The throat 10 of a conical structure projects upwardly.

The shell 100 is provided with a gas mixing tube 30 forming the gas mixing channel 400. The upper end 11 of the throat 10 extends into the gas mixing tube 30. The throat 10 and the gas mixing tube 30 are coaxially provided. The first cut-off portion 201 is formed between the throat 10 and an end portion (the lower end) of the gas mixing tube 30. The second cut-off portion 301 is formed between the throat 10 (the inner wall) and the air cut-off plug 20 (the upper end 21). The first cut-off portion 201 is located at any position of the fuel gas channel 200, i.e. may be located at the tail end, entry end or even a middle position of the fuel gas channel 200. In this embodiment, the first cut-off portion 201 is substantially located at the tail end of the fuel gas channel 200, and fuel gas enters the gas mixing channel 400 after being discharged from the first cut-off portion 201. The second cut-off portion 301 is substantially located at the tail end of the air channel 300, and air enters the gas mixing channel 400 after being discharged from the second cut-off portion 301.

As shown in FIGS. 1 and 2, the air channel 300 has an air inlet 105 that may be communicated with a silencer device. The shell 100 comprises an upper shell 101 and a lower shell 102. The air inlet 105 is located at the lower end of the lower shell 102. The lower end of the upper shell 101 and the upper end of the lower shell 102 are fixedly connected. An upper end cover 106 covers and seals the upper end of the upper shell 101. The gas mixing tube 30 is coaxially provided on the upper end cover 106, forming a mixed gas outlet 103 at the upper end thereof. The throat 10 is located in the shell 100 and moves approximately at the connection part between the upper shell 101 and the lower shell 102. The throat 10 and the gas mixing tube 30 are provided to be coaxial. The fuel gas channel 200 is formed among the throat 10 and gas mixing tube 30 and the upper shell 101, and is located outside the throat 10 and gas mixing tube 30.

In this embodiment, the side wall of the upper shell 101 has a gas side tube 110, which having a fuel gas inlet 104 for inputting fuel gas. The air channel 300 is located inside the throat 10. When facing FIG. 2, the air channel 300 is located on the lower side of the throat 10, and the fuel gas channel 200 and gas mixing channel 400 are located on the upper side of the throat 10.

What needs to be explained is that the upward and downward orientations described in this embodiment are defined based on the orientation facing FIG. 2. In actual use, the installation and use of the gas mixing device is not limited to the state shown in FIG. 2. The gas mixing device does not have to be used in the state shown in FIG. 2. Correspondingly, the "upper end" and "lower end" described in this embodiment may also be changed adaptively. For example, when an actual gas mixing device is in a state opposite (installed inversely) to the state shown in FIG. 2, the "upper end" described in this embodiment becomes the "lower end", and there is no such limitation that the "upper end" described in this embodiment must be the "top end" in use.

In this embodiment, the shell 100 is provided with a driving motor 500. The driving motor 500 is fixedly mounted at the lower end of the shell 100. The driving motor 500 simultaneously drives the throat 10 to move and drives the air cut-off plug 20 to move relative to the throat 10, thereby simultaneously changing the flow areas of the first cut-off portion 201 and the second cut-off portion 301. To be specific, the driving motor 500 can directly drive the air cut-off plug 20 to move and indirectly drive the throat 10 (e.g., the throat 10 can be caused to move by means of the air cut-off plug 20), and can also directly drive the throat 10 to move and indirectly drive the air cut-off plug 20 (e.g., the air cut-off plug 20 can be caused to move by means of the throat 10). Of course, the driving motor 500 can also directly drive the air cut-off plug 20 and the throat 10 simultaneously.

The motions of the air cut-off plug 20 and the throat 10 may be the same, i.e. they move synchronously and equidistantly. That is, the air cut-off plug 20 and the throat 10 have the same speed when doing linear movements, and the transmission ratio between the two is 1:1. In this embodiment, the air cut-off plug 20 and the throat 10 move synchronously in a predetermined transmission ratio. To be specific, considering the mixing ratio between air and fuel gas, the moving speed of the air cut-off plug 20 may be greater than that of the throat 10. The change rate of the flow area of the first cut-off portion 201 may be greater than that of the second cut-off portion 301. The linear movements of the air cut-off plug 20 and the throat 10 are not equal in speed. The air cut-off plug 20 and the throat 10 move upwardly or downwardly together at different speeds to maintain a certain mixing ratio between fuel gas and air, thereby ensuring the stability of combustion.

In this embodiment, in order to realize the linear movements of the air cut-off plug 20 and the throat 10, the driving motor 500 can be a linear motor, and the air cut-off plug 20 is fixedly disposed to sleeve the output shaft (motor shaft) of the linear motor 500. The air cut-off plug 20 can be mounted on the output shaft of the linear motor 500 to perform a linear movement together with the output shaft. The air cut-off plug 20, when moving linearly, causes the throat 10 to move linearly as well.

In order to realize the movement of the throat 10, the throat 10 is connected to the air cut-off plug 20 or the motor shaft of the driving motor by means of a transmission mechanism. The driving motor 500 directly drives the air cut-off plug 20 to move, and the air cut-off plug 20 or the motor shaft of the driving motor causes the throat 10 to move by means of the transmission mechanism. As shown in FIG. 2, the air cut-off plug 20 is fixedly disposed to sleeve the motor shaft of the linear motor 500, and the air cut-off plug 20 is connected to the throat 10 by means of the transmission mechanism. The transmission mechanism is a linkage mechanism by means of which the movement of the air cut-off plug 20 is transmitted to the throat 10, so that when the air cut-off plug 20 moves, it causes the throat 10 to move together with it, and the two maintain a predetermined transmission ratio. Hence, a certain mixing ratio between fuel gas and air is maintained, and the stability of combustion is ensured.

In this embodiment, the transmission mechanism is a linkage mechanism. To be specific, the transmission mechanism comprises a first linkage 41 and a second linkage 42 rotatably connected via a pivot shaft 43. One end of the first linkage 41 is rotatably connected to the air cut-off plug 20, and one end of the second linkage 42 is rotatably connected to the throat 10. In this embodiment, one end of the first linkage 41 may also be directly and rotatably connected to the motor shaft of the driving motor 500, in which case the throat 10 can also be caused to move by means of the transmission mechanism.

As can be seen in FIG. 2, in order to avoid interference on the moving path, the first linkage 41 and the second linkage 42 are curved or micro-bent structures. Of course, in other embodiments, the first linkage 41 and the second linkage 42 can also be straight rods, and the present disclosure does not make a unique limitation. The two ends of the first linkage 41 are respectively hinged to the lower end of the air cut-off plug 20 and one end of the second linkage 42, and the other end of the second linkage 42 is hinged to the lower end of the throat 10. In order to facilitate connection and assembly, the lower end of the throat 10 can extend to form a connection section to be hinged with an end of the second linkage 42. Of course, an end of the second linkage 42 can also be directly hinged with the main body of the throat 10. It can be seen that the transmission mechanism in this embodiment has a simple structure, is easy to assemble and has a low manufacture cost. Moreover, it can keep the throat 10 and air cut-off plug 20 in transmission with a predetermined transmission ratio. An appropriate mixing ratio between fuel gas and air can be maintained while realizing a synchronized movement of the two.

In order to ensure a stable change of the flow areas of the first cut-off portion 201 and the second cut-off portion 301, the shell 100 is provided with a guide structure 50 for guiding the movement of the moving part, enabling the moving part to move stably, thereby changing the combustion power stably. To be specific, the guide structure 50 can guide one of the air cut-off plug 20 and the throat 10. In this embodiment, the guide structure 50 is provided on the gas mixing tube 30. The guide structure 50 comprises a guide rod provided on the gas mixing tube 30. The guide rod and the gas mixing tube 30 are coaxially provided. The upper end of the air cut-off plug 20 is disposed to sleeve the guide rod and slidable relative to the guide rod. When the air cut-off plug 20 performs a linear movement (e.g., the up-down movement shown in FIG. 2), the length of the guide rod extending into the air cut-off plug 20 changes, but the guide rod remains extending into the air cut-off plug 20. Therefore, guiding for the movement of the air cut-off plug 20 is maintained. Of course, the movement of the throat 10 can also be guide by the slidable sealing between the throat 10 and the shell 100.

In this embodiment, the shell 100 is provided therein with a guide mechanism 60 defining a moving path of the pivot shaft 43. When moving in the moving path, the pivot shaft 43 causes the throat 10 to move linearly. As shown in FIG. 2, the guide mechanism 60 is a guide groove fixed on the inner wall of the lower shell 102. The guide groove is disposed obliquely. The end of it close to the air cut-off plug 20 is the upper end, and the end of it away from the air cut-off plug 20 is the lower end. The guide groove is a linear groove. When the air cut-off plug 20 moves downwardly, the pivot shaft 43 moves towards the lower right side (based on the orientation facing FIG. 2) along the guide mechanism (guide groove), and when the air cut-off plug 20 moves upwardly, the pivot 43 moves towards the upper left side.

In this embodiment, the first cut-off portion 201 is the part of the whole fuel gas channel 200 which has the minimum flow area. By changing the size of the flow area of the first cut-off portion 201, the adjustment of the fuel gas supply amount of the fuel gas channel 200 is realized. Correspondingly, the second cut-off portion 301 is the part of the whole air channel 300 which has the minimum flow area. By changing the size of the flow area of the second cut-off portion 301, the adjustment of the air supply amount of the air channel 300 is realized.

To achieve a greater regulation ratio, the ratio of the maximum flow area to the minimum flow area of the first cut-off portion 201 is 10 to 30. For example, the ratio of the maximum flow area to the minimum flow area of the first cut-off portion 201 is around 20. The ratio of the maximum flow area to the minimum flow area of the second cut-off portion 301 is 2 to 6. For example, the ratio of the maximum flow area to the minimum flow area of the second cut-off portion 301 is around 4. The regulation ratio of the gas mixing device provided in FIGS. 1 and 2 can reach 1:20 or above. To be more specific, the regulation ratio of the gas mixing device can reach 1:22, and the gas mixing device can have a lower combustion power and a more stable regulation process, and thereby allows the flue gas emission to be stable and not easy to exceed certain standards during combustion power regulation.

Figure 3:
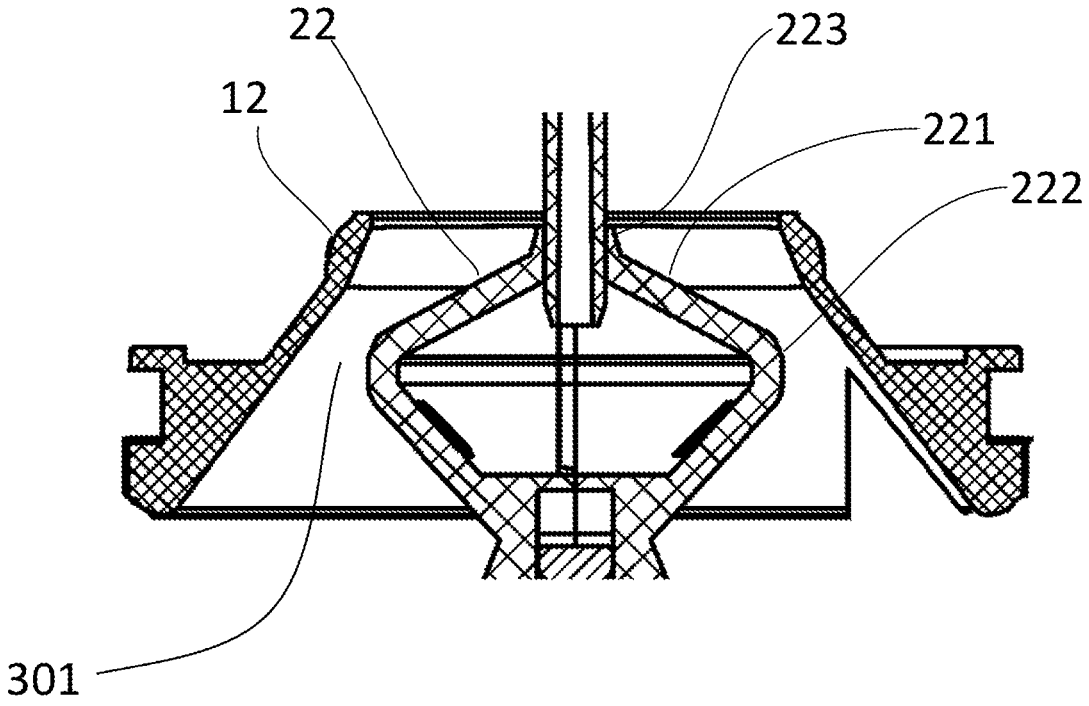
FIG. 3 is a partial enlarged view of FIG. 2.

In this embodiment, the air cut-off plug 20 and the throat 10 are designed to have gradually varied radians, and the regulation ratio of the gas mixing device (Venturi tube) is changed through the radians to achieve a relative large regulation ratio is achieved. Referring to FIGS. 2 and 3, the outer wall of the throat 10 is provided with a first mating surface 12 which participates in forming the first cut-off portion 201. The first mating surface 12 has cambered surfaces with different radians in a moving direction of the throat 10. The throat 10 moves so that cambered surfaces with different radians are respectively matched with the gas mixing tube 30 to change the flow area of the first cut-off portion 201.

In this embodiment, the first mating surface 12 is disposed on the outer wall of the upper end 11 of the throat 10, and the upper end 11 of the throat 10 extends into the lower end of the gas mixing tube 30. The first cut-off portion 201 is formed between the first mating surface 12 and the inner wall of the lower end of the gas mixing tube 30. The first mating surface 12 can be approximately three cambered surfaces of different radians. The cambered surface in the middle projects outwardly, and a smooth transition exist between the cambered surfaces on two sides and the cambered surface in the middle, so that a smooth regulation of the regulation ratio is realized.

The upper end of the air cut-off plug 20 is provided with a second mating surface 22 which participates in forming the second cut-off portion 301. The second mating surface 22 has cambered surfaces with different radians in a moving direction of the air cut-off plug 20. The air cut-off plug 20 moves so that cambered surfaces with different radians are respectively matched with the inner wall of the throat 10 to change the flow area of the second cut-off portion 301. The second cut-off portion 301 is formed between the second mating surface 22 and the inner wall of the throat 10. Referring to FIGS. 2 and 3, the upper end of the air cut-off plug 20 is approximately a diamond structure, the second mating surface 22 also includes approximately three cambered surfaces 221, 222, 223 of different radians, wherein the cambered surface 221 in the middle as a whole is a conical surface, and in fact is a cambered surface with a relative large radian.

In other embodiments, the driving motor 500 can directly drive the throat 10 and the air cut-off plug 20 to move linearly. No transmission mechanism is required between the throat 10 and the air cut-off plug 20, and the motions of the two are the same. The throat 10 and the air cut-off plug 20 can both be fixedly connected to the output shaft of the driving motor 500 directly, or can be respectively driven by the output shaft, or the throat 10 and the air cut-off plug 20 can be fixedly connected to each other with one of them being directly driven by the output shaft of the driving motor 500, so that they are driven together.

In addition, in other embodiments, the transmission mechanism is not limited to a linkage mechanism. For example, the transmission mechanism may also be a worm gear and worm rod, a gear and chain, belt transmission and so on.

Figure 6:
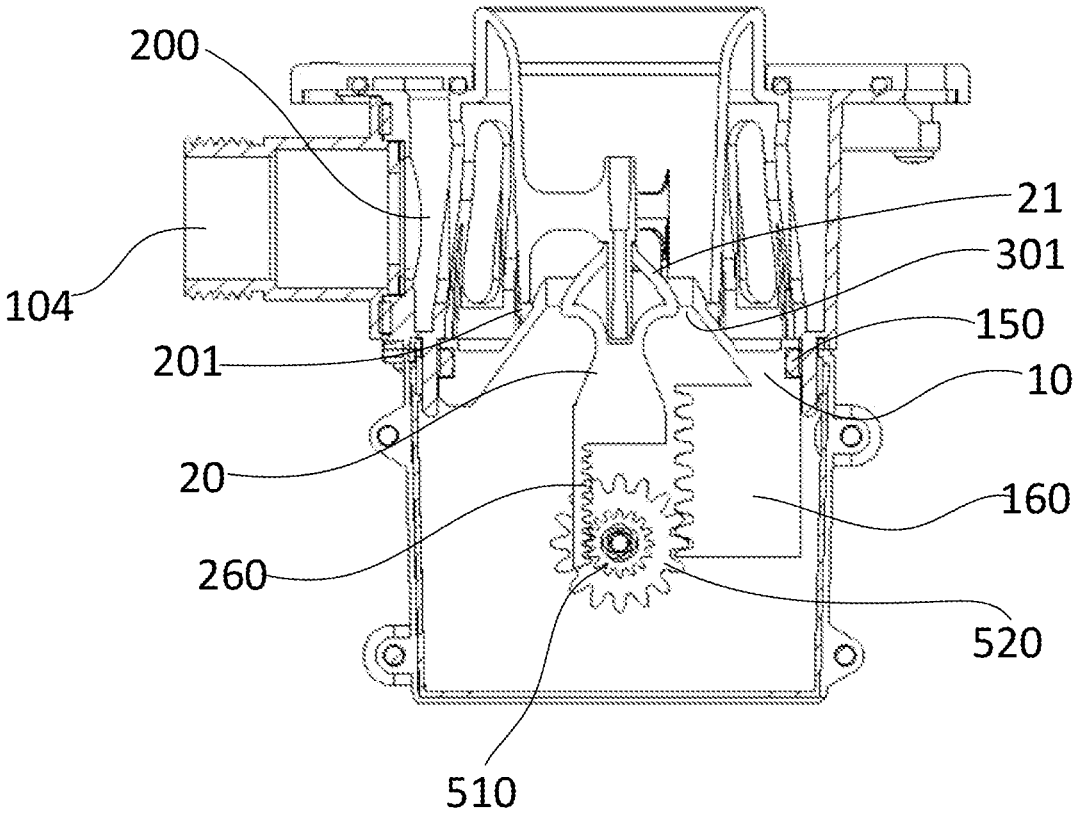
FIG. 6 is a structural cutaway view of a gas mixing device provided by another embodiment of the present disclosure.

In a feasible embodiment as shown in FIG. 6, the driving motor 500 directly drives the throat 10 and the air cut-off plug 20. The output end of the driving motor 500 is provided with a first driving gear 510 and a second driving gear 520 which are coaxially disposed. The air cut-off plug 20 is driven by the driving motor 500 through a first rack 260 and the first driving gear 510 to mesh. The throat 10 is driven by the driving motor 500 through a second rack 160 and the second driving gear 520 to mesh.

The addendum circle diameter of the first driving gear 510 is smaller than that of the second driving gear 520. The screw pitches of the first drive gear 510 and the second drive gear 520 are different. In this embodiment, the above linkage mechanism is changed to be the gear and rack with different screw pitches in this embodiment to realize a synchronous and coaxial linear motion of air and fuel gas at different distances.

For the air cut-off plug 20, throat 10 and gas mixing tube 30 in this embodiment, reference can be made to the description in the embodiment of FIGS. 1 and 2, and no redundant depiction will be given in this embodiment.

Figure 4:
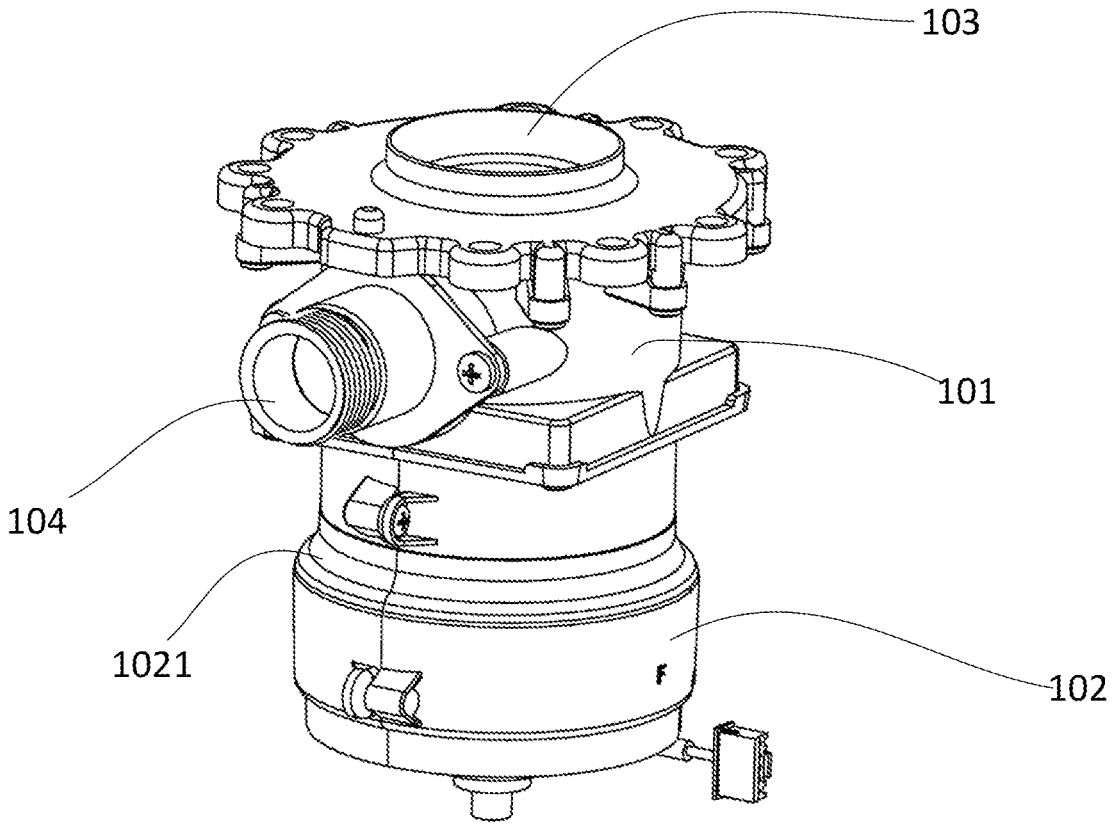
FIG. 4 is a structural diagram of a gas mixing device provided by another embodiment of the present disclosure.
Figure 5:
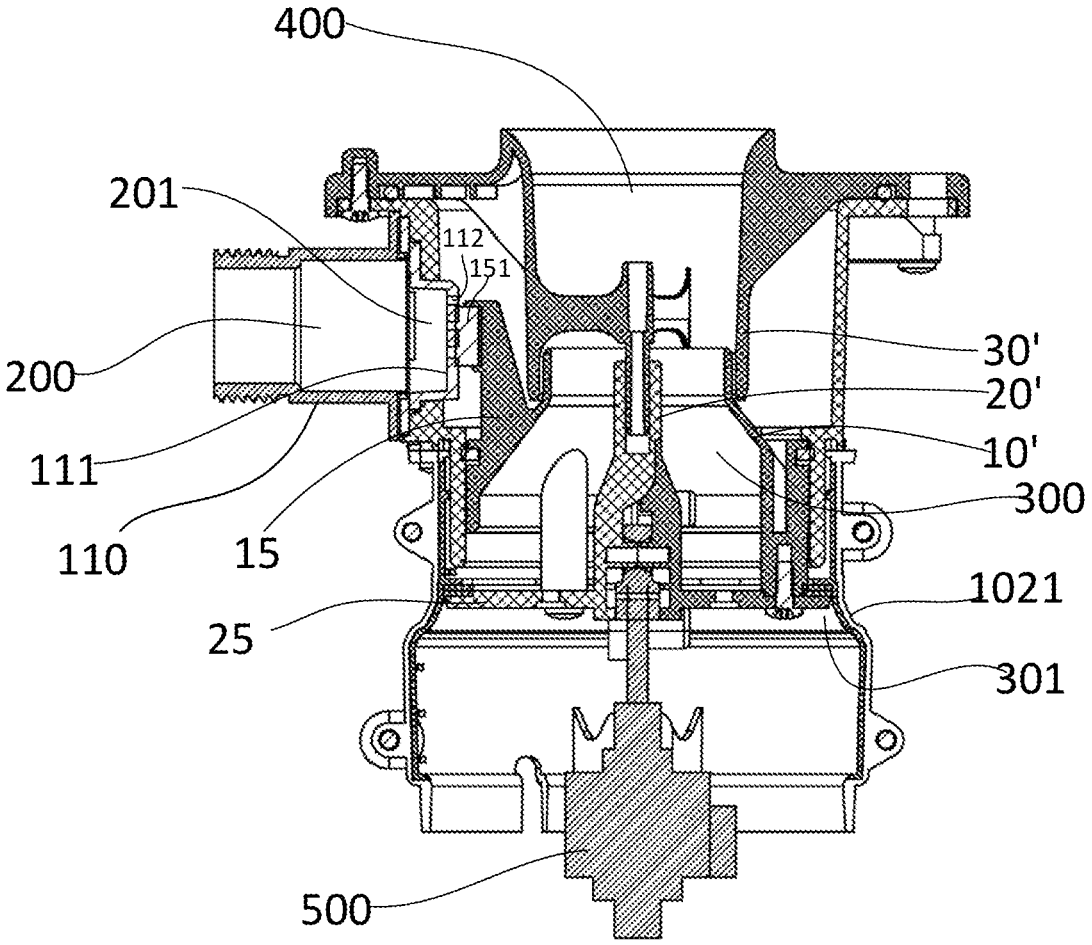
FIG. 5 is a cutaway view of FIG. 4.

In another specific embodiment, as can be seen from FIGS. 4 and 5, the shell 100 is provided with a gas mixing tube 30' forming the gas mixing channel 400. The moving part comprises an air cut-off plug 20' and a throat 10' that is disposed to sleeve the air cut-off plug 20'. The upper end of the throat 10' is cylindrical. The upper end of the cylinder always extends into the gas mixing pipe 30' during the movement of the throat 10', thus the flow area there is namely the cross sectional area of the annular space between the cylindrical upper end and the gas mixing tube 30'. Besides, the flow area between the throat 10' and gas mixing tube 30' remains unchanged during the movement of the throat 10'.

A baffle plate 111 is provided in the fuel gas channel 200. The baffle plate 111 is provided with a flow hole 112 which penetrates the baffle plate. The flow area (the cross sectional area) between the throat 10' and the gas mixing tube 30' is greater than the flow area of the first cut-off portion 201. Preferably, the flow area between the throat 10' and the gas mixing tube 30' is greater than the area of the flow hole 112 which is not shielded (the maximum flow area of the first cut-off portion 201). The side wall of the upper shell 101 has a fuel gas side tube 110, the baffle plate 111 is located at the tail end of the fuel gas side tube 110, and fuel gas passes through the flow hole 112 of the baffle plate 111 and enter the inner cavity of the upper shell 101 (the annulus space between the inner wall of the shell 101 and the gas mixing tube 30'). The overall fuel gas side tube 110 is perpendicular to the gas mixing tube 30', and the flow hole 112 faces towards the side wall of the gas mixing tube 30'.

To be specific, the communication area of the flow hole 112 is namely the flow area of the first cut-off portion 201. The baffle plate 111 may be a porous wall surface structure, the flow hole 112 comprises a plurality of air holes distributed on the baffle plate 111, which can be arranged to be an approximately triangular structure, and the number of the air holes increases gradually from top to bottom. Of course, in other embodiments, the flow hole may be a single triangular hole, so that the flow area of the first cut-off portion 201 can be smoothly changed.

The throat 10' is fixedly provided with a shielding structure 15 for shielding the flow hole 112. The shielding structure 15 moves to change a shielded area of the flow hole 112, so as to change the flow area of the first cut-off portion 201. The shielding structure 15 changes the number of the shielded air holes to change the communication area of the flow hole 112, and thus the flow area of the first cut-off portion 201 can be changed. The shielding structure 15 is disposed on the outer side wall of the throat 10' and is provided with fuel gas cut-off cotton 151, and thus has a better sealing effect when being attached to the inner wall surface of the baffle plate 111, so that fuel gas can pass through the part of the flow hole 112 which is not shielded.

The air cut-off plug 20' is fixedly provided with an air cut-off plate 25. The shell 100 is provided with a variable-diameter portion 1021. The variable-diameter portion 1021 is located on the lower shell 102. In this embodiment, the internal cross sectional area (flow area) of the variable-diameter portion 1021 decreases gradually in the air flow direction. When the inner cavity cross section of the lower shell 102 is circular, the internal diameter of the variable-diameter portion 1021 decreases gradually in the air flow direction. The air cut-off plate 25 and the variable-diameter portion move relative to each other to change the flow area of the second cut-off portion 301.

To be specific, the upper end of the air cut-off plug 20' does not need to have the structure shown in FIGS. 1 and 2, and the air cut-off plug 20' can be a cylindrical structure as a whole. The flow area between the air cut-off plug 20' and the inner wall of the throat 10' is always greater than the flow area between the air cut-off plate 25 and the variable-diameter portion 1021. Hence, the second cut-off portion 301 is formed between the air cut-off plate 25 and the variable-diameter portion 1021, and the change of the flow area between the air cut-off plate 25 and the variable-diameter portion 1021 can affect the amount of air. The air cut-off plate 25 is fixedly connected to the lower end of the air cut-off plug 20'. The relative position of the air cut-off plate 25 in the variable-diameter portion 1021 is changed by the axial movement (linear movement or up and down movement) of the air cut-off plate 25, and accordingly the flow area of the annular channel between the air cut-off plate and the variable-diameter portion 1021 is changed corresponding to parts of the variable-diameter portion 1021 that have different cross sectional areas.

In this embodiment, the throat 10', the air cut-off plate 25 and the air cut-off plug 20' are assembled into one piece and move coaxially, synchronously and equidistantly with the motor 500 as the (linear) motor 500 extends and contracts.

Based on the same idea, the embodiments of the present disclosure also provide a gas water heating device as described in the following embodiments. Since the principles by which the gas water heating device solves problems and the technical effects which the gas water heating device can achieve are similar to that of the gas mixing device. Reference can be made to the implementation of the gas mixing device described above for the implementation of the gas water heating device. No redundant depiction will be given for the repeated content.

A further embodiment of the present disclosure provides a gas water heating device comprising the gas mixing device according to any one of the above embodiments. The gas mixing device can be communicated upstream of the combustor of the gas water heating device for providing premixed gas to the combustor and providing fuel gas to the combustor. The gas water heating device is preferably a fully premixed gas water heater.

Any numeral values cited in this text include all values of the lower values and the upper values from the lower limit value to the upper limit value, in increments of one unit, provided that there is a separation of at least two units between any lower value and any higher value. For example, if a value illustrating the number or process variable (such as temperature, pressure and time, etc.) of a component is from 1 to 90, preferably from 20-80, and more preferably from 30 to 70, then the purpose is to explain that the Description also explicitly enumerates values such as 15 to 85, 22 to 68, 43 to 51 and 30 to 32. For values which are less than one, one unit is appropriately considered to be 0.0001, 0.001, 0.01 or 0.1. These are only examples intended to be explicitly expressed, and all possible combinations of numerical values between the lowest value and the highest value enumerated are all expressly stated in the Description in similar ways.

Unless otherwise stated, all ranges include the endpoints and all numbers that fall between the endpoints. The use of "about" or "approximately" together with a range applies to both ends of the range. Therefore, "about 20 to 30" is intended to cover "about 20 to about 30", inclusive of at least the specified endpoints.

All disclosed articles and reference materials, including patent applications and publications, are incorporated herein by reference. The term "substantially formed of . . . " describing combinations should include the determined elements, components, parts or steps as well as other elements, components, parts or steps that do not affect the basic novel features of the combination in substance. The use of the term "contain" or "include" to describe the combinations of elements, components, parts or steps herein also give rise to the embodiments constituted substantially by these elements, components, parts or steps. The term "may" as used herein is intended to explain that any attribute included by the "may" as described is selectable.

Multiple elements, components, parts or steps can be provided by a single integrated element, component, part or step. Alternatively, a single integrated element, component, part or step can be divided into multiple separate elements, components, parts or steps. The disclosed "a" or "an" used for describing elements, components, parts or steps do not exclude other elements, components, parts or steps.

It is to be understood that the above description is intended to be graphically illustrative and not restrictive. Many embodiments and applications other than the examples provided would be apparent to those skilled in the art upon reading the above description. Therefore, the scope of the present teaching should not be determined with reference to the above description, but should, instead, be determined with reference to the appended claims, along with the full scope of the equivalents thereof. The disclosures of all articles and references, including patent applications and publications, are incorporated by reference for all purposes. The omission in the foregoing claims of any aspect of the subject matter that is disclosed herein is not a disclaimer of this subject matter, nor should it be regarded as the inventors not considering this subject matter to be a part of the disclosed utility model subject matter.

What is claimed is:

1. A gas mixing device comprising:

a shell provided with a fuel gas channel for inputting fuel gas, an air channel for inputting air, and a gas mixing channel, the fuel gas channel being provided with a first cut-off portion capable of changing a flow area and the air channel being provided with a second cut-off portion capable of changing a flow area, a moving part movable within the shell, the moving part being configured to simultaneously change the flow areas of the first cut-off portion and the second cut-off portion by moving, wherein the moving part comprises an air cut-off plug and a throat that is disposed to sleeve the air cut-off plug; and a contraction structure provided on the throat, the air channel being located inside the throat and the contraction structure and the fuel gas channel being located outside the throat and the contraction structure;

wherein an internal flow area of the contraction structure gradually decreases in an air flow direction to form a contraction section, wherein at least part of the internal flow area of the gas mixing channel gradually increases in an internal gas flow direction to form a diffusion section;

wherein the fuel gas channel is communicated between the contraction section and the diffusion section;

wherein an outer wall of the throat and an inner wall of the shell are provided with sealing structures slidable relative to each other; and wherein the sealing structures seal and separate the air channel and the fuel gas channel.

2. The gas mixing device according to claim 1, wherein the shell is provided with a driving motor, which simultaneously drives the throat to move and drives the air cut-off plug to move relative to the throat, thereby simultaneously changing the flow areas of the first cut-off portion and the second cut-off portion.

3. The gas mixing device according to claim 2, wherein the shell is provided with a gas mixing tube forming the gas mixing channel; the first cut-off portion is formed between the throat and an end portion of the mixing tube; and the second cut-off portion is formed between the throat and the air cut-off plug.

4. The gas mixing device according to claim 3, wherein the outer wall of the throat is provided with a first mating surface which participates in forming the first cut-off portion; the first mating surface has cambered surfaces with different radians in a moving direction of the throat; and the throat moves so that the cambered surfaces with different radians are respectively matched with the gas mixing tube to change the flow area of the first cut-off portion.

5. The gas mixing device according to claim 3, wherein the driving motor directly drives the throat and the air cut-off plug to move linearly.

6. The gas mixing device according to claim 5, wherein an output end of the driving motor is provided with a first driving gear and a second driving gear which are coaxially disposed; the air cut-off plug is driven by the driving motor through a first rack and the first driving gear to mesh; the throat is driven by the driving motor through a second rack and the second driving gear to mesh; and an addendum circle diameter of the first driving gear is smaller than that of the second driving gear.

7. The gas mixing device according to claim 5, wherein the shell is provided with a gas mixing tube forming the gas mixing channel; the moving part comprises an air cut-off plug and a throat that is disposed to sleeve the air cut-off plug;

the fuel gas channel is provided therein with a baffle plate; the baffle plate is provided with a flow hole which penetrates the baffle plate; the throat is fixedly provided with a shielding structure for shielding the flow hole; and the shielding structure moves to change a shielded area of the flow hole, so as to change the flow area of the first cut-off portion;

the air cut-off plug is fixedly provided with an air cut-off plate; the shell is provided with a variable-diameter portion; and the air cut-off plate and the variable-diameter portion move relative to each other to change the flow area of the second cut-off portion.

8. The gas mixing device according to claim 2, wherein the air cut-off plug and the throat move synchronously in a predetermined transmission ratio.

9. The gas mixing device according to claim 2, wherein the throat is connected to the air cut-off plug or a motor shaft of the driving motor through a transmission mechanism; the driving motor directly drives the air cut-off plug to move, and the air cut-off plug or the motor shaft of the driving motor causes the throat to move through the transmission mechanism.

10. The gas mixing device according to claim 9, wherein the transmission mechanism is a linkage mechanism.

11. The gas mixing device according to claim 10, wherein the transmission mechanism comprises a first linkage and a second linkage which are rotatably connected through a pivot shaft; wherein one end of the first linkage is rotatably connected to the air cut-off plug or the motor shaft of the driving motor, and one end of the second linkage is rotatably connected to the throat.

12. The gas mixing device according to claim 11, wherein the shell is provided therein with a guide mechanism defining a moving path of the pivot shaft; and when moving in the moving path, the pivot shaft causes the throat to move linearly.

13. The gas mixing device according to claim 2, wherein the driving motor is a linear motor; and the air cut-off plug is fixedly disposed to sleeve an output shaft of the linear motor.

14. The gas mixing device according to claim 1, wherein an upper end of the air cut-off plug is provided with a second mating surface which participates in forming the second cut-off portion; the second mating surface has surfaces with different radians in a moving direction of the air cut-off plug; and the air cut-off plug moves so that surfaces with different radians are respectively matched with an inner wall of the throat to change the flow area of the second cut-off portion.

15. The gas mixing device according to claim 1, wherein a ratio of a maximum flow area to a minimum flow area of the first cut-off portion is 10 to 30; and a ratio of a maximum flow area to a minimum flow area of the second cut-off portion is 2 to 6.

16. The gas mixing device according to claim 1, wherein the moving part moves linearly in the shell.

17. A gas water heating device, wherein comprising the gas mixing device according to claim 1.

* * * * *